United States Patent [19]

Gianessi

[11] 4,073,524

[45] Feb. 14, 1978

[54] RESTRAINT ASSEMBLY FOR A TRACTOR HOOD

[75] Inventor: Albert Gianessi, East Peoria, Ill.

[73] Assignee: Caterpillar Tractor Co., Peoria, Ill.

[21] Appl. No.: 714,426

[22] Filed: Aug. 13, 1976

[51] Int. Cl.[2] ..... E05C 3/04

[52] U.S. Cl. ..... 292/341.12; 292/193

[58] Field of Search ..... 292/DIG. 39, DIG. 40, 292/193, 261, 204, 103, DIG. 38

[56] References Cited

U.S. PATENT DOCUMENTS

| | | | |
|---|---|---|---|
| 775,618 | 11/1904 | Zimmerman | 292/241 X |
| 1,089,193 | 3/1914 | Ervien | 292/DIG. 39 |
| 1,490,575 | 4/1924 | Masury et al. | 292/87 X |
| 1,766,183 | 6/1930 | Mealia | 292/DIG. 40 |
| 2,349,301 | 5/1944 | Overby | 292/193 X |
| 3,782,765 | 1/1974 | Wallyn | 292/204 X |

*Primary Examiner*—Richard E. Moore

*Attorney, Agent, or Firm*—Wegner, Stellman, McCord, Wiles & Wood

[57] ABSTRACT

A restraint assembly employed in conjunction with a resilient latch assembly for securing two adjoining elements together includes a pair of spaced walls carried by one of the elements and a pair of resilient rollers carried by the other element. The rollers are positioned within the space between the walls so that one of the rollers bears against one wall and the other roller bears against the other opposing wall to prevent relative motion between the elements.

6 Claims, 4 Drawing Figures

RESTRAINT ASSEMBLY FOR A TRACTOR HOOD

BACKGROUND OF THE INVENTION

1. Field of the Invention

This invention relates to a fastening arrangement and, more particularly, to a restraint assembly employed with a resilient latch assembly to limit relative movement between two elements connected by the resilient latch assembly.

2. Description of the Prior Art

In the past, it has generally been a common practice to secure structural components or elements together by employing nuts, bolts, hinges and the like. In order to assure proper alignment of the elements, it has been necessary to construct adjoining, connected elements within specific tolerances. If the tolerances were made too large, the elements would often be misaligned slightly or fit together loosely. If the tolerances were too small, there was the possibility that the elements would still be misaligned or not fit together at all, particularly in hazardous environments where the elements were subject to damage tending to distort the elements.

A cost effective alternative, which may be suitable in noncritical applications, is to design the elements so that exact fit of the elements is not required. While such designs provide a great deal of flexibility, the elements often still need to be rigidly secured together in appropriate interrelationship. One method of securing two elements together so that they do not move apart is to utilize resilient latches, thus permitting compensation for inaccurate or altered dimensions of the elements and allowing for quick, easy connection. However, where a resilient latch is employed, some relative motion is still permitted between the elements, particularly in a direction in which the resilient latch does not provide a substantial holding force.

SUMMARY OF THE INVENTION

Accordingly, it is the principal object of the invention to provide a fastening assembly which provides substantially correct alignment of the adjoining elements and still positively maintain the elements secured despite harsh use or severe stress.

A restraint assembly constructed according to the invention to prevent sliding movement between two elements fastened together by a resilient latch assembly includes a pair of resilient rollers carried by one of the elements and a pair of spaced walls fixedly carried by the other of the elements. The elements are positioned so that the rollers are disposed between the walls with one of the rollers bearing against one of the walls in one direction and the other roller bearing against the other wall in the opposite direction to prevent relative movement of the elements in either direction.

The restraint assembly when employed with a resilient latch assembly eliminates excess hardware, such as nuts and bolts, and reduces the time and effort required to connect or release the elements. The components of the restraint assembly and the resilient latch assembly are permanently fixed to the appropriate elements so that they cannot become lost or misplaced when released. In addition, the elements may be connected or released without the use of special tools or devices.

Resilient rollers are employed to facilitate easy assembly of the elements and to permit a snug, but releasable fit between the elements. Because of the resilient composition of the rollers, noise caused by vibration between the elements is substantially reduced.

The restraint assembly of the invention has one of its best applications in securing a removable hood to a vehicle frame so as to prevent forward and rearward movement of the hood on the vehicle frame.

BRIEF DESCRIPTION OF THE DRAWINGS

The details of construction and operation of the invention are fully described with reference to the accompanying drawings which form a part hereof and in which like reference numerals refer to like parts throughout.

In the drawings.

DESCRIPTION OF THE PREFERRED EMBODIMENT

Figure 1:
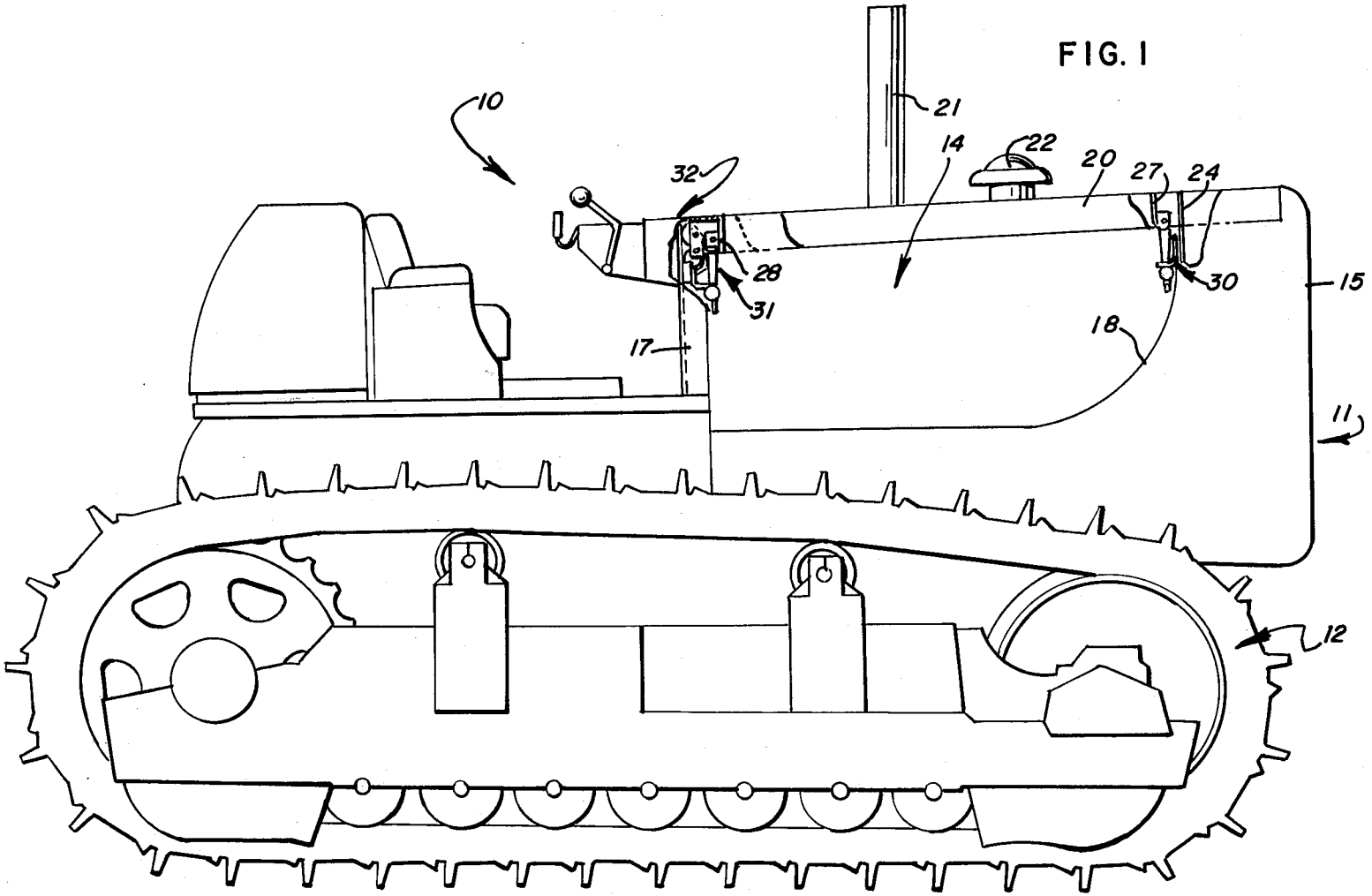
FIG. 1 is a side elevational view of a track-type tractor partially broken away to show the fastening assembly of the invention in use.

In FIG. 1, a track-type tractor 10 is illustrated which is comprised of a frame, generally designated 11, upon which an endless track, generally designated 12, is mounted, and an engine and transmission assembly 14 carried by the frame 11 for driving the track 12 circuitously. Although a tracked vehicle is illustrated, it is contemplated that the invention can be used on any vehicle or any machinery or apparatus. The engine and transmission assembly 14 is partially enclosed within a compartment defined by frame members including a forward vertical radiator guard 15, a rearward vertical firewall 17, lateral vertical engine guards, one of which is designated 18, and a removable horizontal upper hood 20. An exhaust pipe 21 and a precleaner 22 extend upwardly through the hood 20 from the engine compartment.

The hood 20 is secured to the rearward firewall 17 and extends forward longitudinally where it is secured to a forward vertical support member 24. The forward part of the hood 20 rests on and is supported by the forward part of the frame 11, such as the support member 24. At the rear, the hood 20 rests on and is supported by the rearward part of the frame 11, which may be the firewall 17. The hood 20 is arcuately shaped so that it extends downwardly slightly on either lateral side of the frame 11. The hood 20 includes two transversely extending support brackets 27 and 28 fixed to the underside of the hood 20 and extending downwardly into the engine compartment. The forward support bracket 27 is spaced inwardly a small distance from the forward support member 24. The rearward support bracket 28 is similarly spaced from the firewall 17.

As seen in FIG. 1, the hood 20 is secured to the frame 11 forwardly by a pair of forward resilient latch assemblies 30 and rearwardly by a pair of resilient latch assemblies 31 and a pair of restraint assemblies 32. A latch assembly 30 or 31 is disposed at each of the four corners of the hood 20. A restraint assembly 32 is employed only at the rearward corners of the hood 20. The latch assemblies 30 and 31 secure the hood 20 against vertical movement, while the restraint assemblies 32 secure the hood 20 against movement forwardly and rearwardly.

Figure 2:
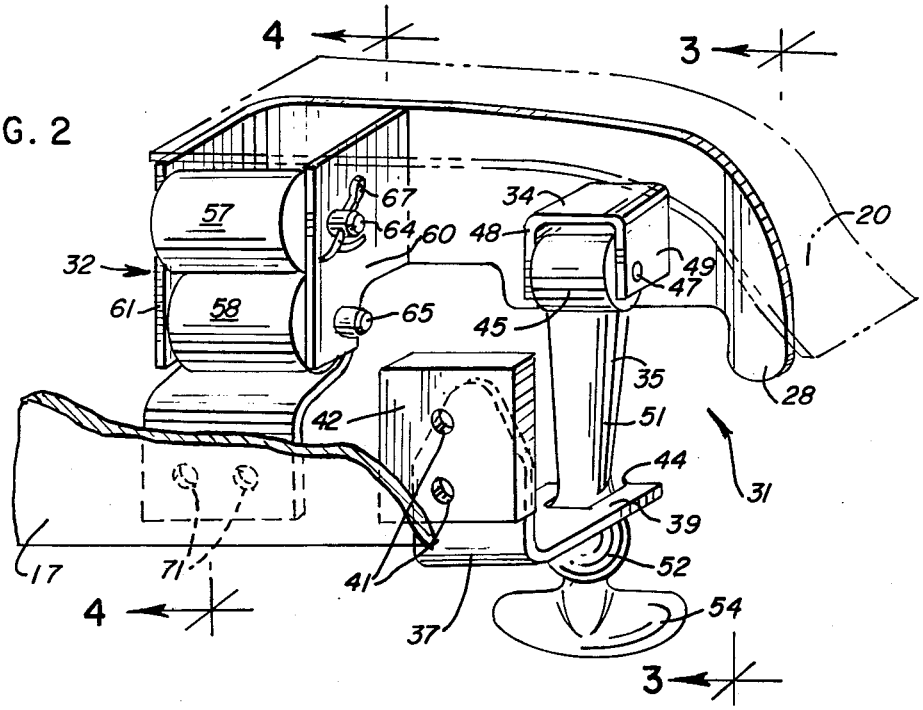
FIG. 2 is a partial perspective view of a rearward fastening assembly as employed in FIG. 1 with parts broken away.
Figure 3:
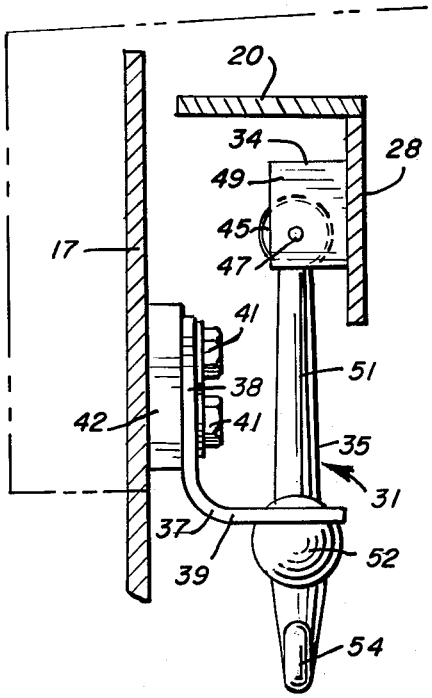
FIG. 3 is a cross-sectional view of the resilient latch assembly taken along line 3—3 of FIG. 2; and, FIG. 4 is a cross-sectional view of the restraint assembly constructed according to the invention taken along line 4—4 of FIG. 2.

Each of the latch assemblies 30 and 31 are constructed similarly. Referring to FIGS. 2 and 3, the construction of the latch assembly 31 is seen to include a U-shaped bracket 34 extending rearwardly from the rearward support bracket 28, a resilient latch member 35 mounted by the bracket 34, and an L-shaped bracket 37 mounted to the firewall 17.

The bracket 37 has a rearward vertical portion 38 and a forwardly extending portion 39. The rearward portion 38 is secured to the firewall 17 by bolts 41 passing into a mounting block 42 also mounted on the firewall 17. The forward portion 39 extends generally perpendicular to the firewall 17 and parallel with the hood 20 and has a slot 44 formed therein.

The latch member 35 has a cylindrical upward end 45 connected to the bracket 34 by a pin 47 extending between the bracket sides 48 and 49 so that the latch member 35 swings freely therebetween. The latch member 35 has a narrowed central portion 51, a bulbous portion 52 and a handle portion 54. The latch member 35 is extensible such that the handle portion 54 can be pulled downwardly to permit the bulbous portion 52 to be pulled past the slot 44 so that the central portion 51 can be slid into the slot 44. The underside of the slot 44 may be concave to maintain the bulbous portion 52 more securly engaged with the bottom of the slot 44. The resiliency of the latch member 35 causes the bulbous portion 52 to be pulled upwardly under the bracket 37 so that the latch member 35 is under tension to resiliently hold the hood 20 in place on the stationary support members 17 and 24.

Figure 4:
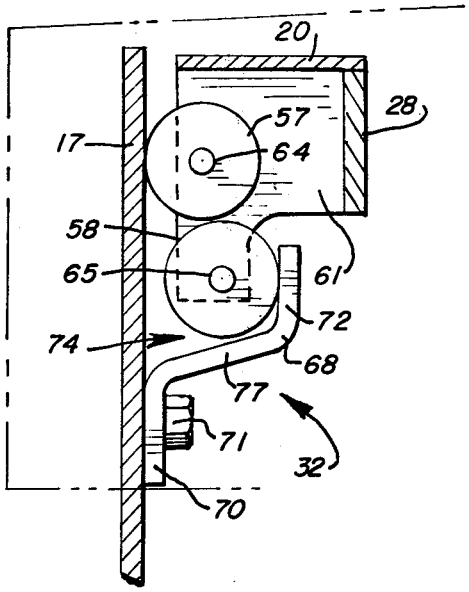

The restraint assembly 32, best seen in FIGS. 2 and 4, includes a pair of resilient rollers 57 and 58 mounted for rotation between two projecting L-shaped brackets 60 and 61 extending rearwardly from the rearward support bracket 28. The rollers 57 and 58 are mounted for rotation by pins 64 and 65 having an enlarged head at one end and having its other end held in position by a cotter pin 67, one of which is shown.

The restraint assembly 32 also includes a Z-shaped bracket 68 having one portion 70 secured to the firewall 17 by a bolt 71 and having another portion 72 spaced inwardly from and generally parallel to the firewall 17 so as to define a space 74 having an upwardly extending mouth opening toward the hood 20.

The rollers 57 and 58 are at least partially inserted into the space 74 and engage the firewall 17 and the bracket portion 72, respectively. The rollers 57 and 58 are mounted so as to have their axes of rotation generally parallel to the plane of the firewall 17 and perpendicular to direction of insertion of the rollers 57 and 58. The roller 57 is positioned to bear against the firewall 17 and the roller 58 is positioned to bear against the bracket portion 72. Herein, the roller 57 is set rearwardly of the roller 58 so that together the rollers 57 and 58 span the space 74 so that they are not longitudinally movable within the space 74. The engagement of the rollers on the stationary support members in opposite directions prevents the hood 20 from moving forwardly or rearwardly on the frame 11. The rollers 57 and 58 are held within the space 74 by the resilient latch assemblies 30 and 31.

As seen in FIG. 4 to some extent, the lower roller 58 may rest on the bottom central portion 77 of the bracket 68 to support the rearward portion of the hood 20 on the frame 11.

In use, the hood 20 is placed over the frame 11 so that the rollers 57 and 58 are positioned within the space 74 defined by the bracket 68. By reaching into the open engine compartment, the latch member 35 can be pulled down and slid into the latch slot 44, thereby securing the hood 20 against upward as well as longitudinal movement.

This type of fastening assembly is simple, fast and efficient, all of which contributes to a savings in time and material. Furthermore, it is highly reliable, dependable and effective.

What is claimed is:

1. In a fastening arrangement for securing a first element to a second element disposed adjacent to the first element including resilient latch means carried by one of said elements and resiliently engaging with the other of said elements to prevent the elements from being moved directly apart, a restraint assembly comprising a pair of spaced walls on the first element, one of said walls being integral with the first element, the other of said walls being defined by a generally Z-shaped bracket having one end portion fixed to the first element and having the other end portion spaced from and generally parallel to the first element to define a space, a pair of resilient rollers carried by the second element and adapted to be inserted into and to span said space between said walls, one of the rollers engaging one of said walls and the other of said rollers engaging the other of said walls to restrict the elements from slidable movement relative to each other.

2. The restraint assembly of claim 1, wherein said resilient rollers are mounted to the second element in a position where each of their axes of rotation is generally parallel to said walls and generally perpendicular to the direction of their insertion within the space between said walls.

3. The restraint assembly of claim 2 wherein said axes of rotation of the rollers are longitudinally offset relative to each other to position said resilient rollers at differing distances from said walls.

4. In a fastening arrangement for securing a first element to a second element disposed adjacent to the first element including resilient latch means carried by one of said elements and resiliently engaging with the other of said elements to prevent the elements from being moved directly apart, a restraint assembly comprising a bracket fixed to the first element having one portion spaced from and generally parallel to the first element to define a space between said portion of said bracket and the first element, and a pair of resilient rollers carried by the second element and adapted to be inserted into and span said space, one of said rollers engaging said portion of said bracket and the other of said rollers engaging the first element to restrict the elements from slidable movement relative to each other.

5. A fastening arrangement for securing a first element to a second element disposed adjacent the first element comprising a pair of spaced walls fixed to the first element, a pair of resilient rollers carried by the second element adapted to be inserted into the space between said spaced walls, one of said rollers engaging one of said walls and the other of said rollers engaging the other of said walls to prevent relative sliding motion between the elements, a bracket fixed to the first element having a portion extending from and generally parallel to the second element, said portion of said bracket having a slot formed therein, and a resilient latch member having an enlarged end portion and having its other end portion fixed to the second element, said latch member having an intermediate portion inserted in said slot so that said enlarged portion engages said bracket under tension to hold said rollers in the space and prevent relative motion between the elements directly away from each other.

6. A fastening arrangement for securing a first element to a second element disposed adjacent and generally perpendicular to the first element comprising a first bracket fixed to the first element having a portion spaced from and generally parallel to the first element, a pair of resilient rollers carried by the second element adapted to be inserted into the space between said portion of said first bracket and the first element, one of said rollers engaging the first element and the other of said rollers engaging said portion of said first bracket to prevent relative motion between the elements in a direction generally perpendicular to the first element, a second bracket fixed to the first element having a portion extending from and generally perpendicular to the first element, said portion of said second bracket having a slot formed therein, and a resilient latch member having an enlarged end portion and having its other end portion fixed to the second element, said latch member having an intermediate portion inserted in said slot so that said enlarged portion engages said second bracket under tension to hold said rollers in the space and prevent relative motion between the elements away from each other in a direction generally parallel to the first element.

* * * * *